US006189827B1

(12) United States Patent
Vollenweider

(10) Patent No.: US 6,189,827 B1
(45) Date of Patent: Feb. 20, 2001

(54) PROCESS AND APPARATUS FOR STORING BLANKS

(75) Inventor: Jürg Vollenweider, Fehraltorf (CH)

(73) Assignee: Ferag AG, Hinwil (CH)

( * ) Notice: Under 35 U.S.C. 154(b), the term of this patent shall be extended for 0 days.

(21) Appl. No.: 08/433,231

(22) Filed: May 2, 1995

(30) Foreign Application Priority Data

May 2, 1994 (CH) ..... 1356/94

(51) Int. Cl.[7] ..... B65H 39/14

(52) U.S. Cl. ..... 242/528; 53/447; 53/540; 271/3.05; 271/216

(58) Field of Search ..... 242/528, 531, 242/531.1; 53/430, 447, 540, 118; 271/3.05, 3.01, 213, 216

(56) References Cited

U.S. PATENT DOCUMENTS

| | | | | |
|---|---|---|---|---|
| 3,412,843 | * | 11/1968 | Maulini | 53/540 X |
| 4,034,846 | * | 7/1977 | Burgis et al. | 271/213 X |
| 4,771,896 | | 9/1988 | Newsome . | |
| 4,866,910 | * | 9/1989 | Reist | 53/430 |
| 4,869,487 | * | 9/1989 | Uno | 271/3.05 |
| 4,898,336 | | 2/1990 | Reist . | |
| 5,048,264 | * | 9/1991 | Frohlich | 53/118 X |
| 5,088,711 | * | 2/1992 | Newsome | 271/216 X |
| 5,158,242 | | 10/1992 | Honegger . | |
| 5,158,278 | | 10/1992 | Auf der Mauer . | |
| 5,176,333 | | 1/1993 | Stauber . | |
| 5,336,041 | | 8/1994 | Seidel et al. . | |
| 5,343,670 | * | 9/1994 | Gombos et al. | 53/447 X |
| 5,508,818 | * | 4/1996 | Hamma | 271/3.05 X |

FOREIGN PATENT DOCUMENTS

| | | | |
|---|---|---|---|
| 29 23 991 | | 12/1980 | (DE) . |
| 42 35 452 | | 4/1994 | (DE) . |
| 1070102 | * | 1/1984 | (RU) ..... 271/3.05 |

* cited by examiner

*Primary Examiner*—Donald P. Walsh
*Assistant Examiner*—William A. Rivera
(74) *Attorney, Agent, or Firm*—Alston & Bird LLP

(57) ABSTRACT

A process and apparatus for storing stackable, sheet-like blanks delivered individually one after the other, in particular for packaging. The individual blanks are fed to an intermediate store which comprises a stack of the blanks, and the blanks are withdrawn from the intermediate store by a conveying device as an essentially continuously blank stream. The withdrawn blanks are then wound onto a rotationally driven winding core to form a wound roll of the blanks.

11 Claims, 6 Drawing Sheets

PROCESS AND APPARATUS FOR STORING BLANKS

BACKGROUND OF THE INVENTION

The invention relates to a process and to an apparatus for storing stackable, sheet-like blanks which are delivered individually one after the other, in particular for packaging.

It is known, for example in order to produce packaging, to coat and/or to print on an elongate material web which runs through a cutting device, and in which the web is cut into individual blanks each suitable for producing a packaging unit. These sheet-like blanks are then bound to form stacks and, as such, are transported to a usually remote device, in which the individual blanks are conveyed away one after the other from the respective stack, then folded to form a packaging unit in each case, and finally filled and sealed.

The procedure described above is disadvantageous in that the finished blanks have to be laboriously bound to form stacks for the purpose of transportation, in that only stacks of a limited height can be formed, this resulting in it being possible for the blanks to be transported only in a large number of small stack units, in that during further processing of the stacks, care has to be taken that the blanks are correctly oriented, and in that, before their further processing, the bound-together stacks first of all have to be freed of the elements holding them together.

An object of the invention is to provide a process and an apparatus of the type mentioned in the introduction, by means of which blanks can be gathered together in a simple manner to form transport units, each exhibiting as large a number of blanks as possible. This renders possible a simple further processing of the blanks which have been gathered together to form the transport units.

The above and other objects and advantages of the present invention are achieved by the provision of a process and apparatus which feeds the blanks individually one after the other to an intermediate store which comprises a stack of the blanks. The blanks are then withdrawn from the intermediate store and fed in an essentially continuous stream to a winding station, and at the winding station the stream of blanks is wound into a roll. The winding may be performed for example by the apparatus disclosed in U.S. Pat. Nos. 5,176,333 and 4,898,336.

By virtue of the measures according to the invention, the blanks delivered individually one after the other can be wound onto a winding core, which, in comparison with conventional stacks, can receive a considerably larger number of blanks. In this manner, handling of the stored blanks is considerably simplified since, instead of a multiplicity of small stacks, only a small number of wound winding cores needs to be transported from the unit which produces the blanks to the unit which further processes the blanks.

In accordance with the present invention, the winding cores bearing the blanks can be deposited, for example, on pallets and transported by means of a fork lift truck.

After unwinding of the blanks stored on the winding cores, the empty winding cores can be re-used for storing new blanks. In this respect too, there is an advantage over the prior conventional procedure since the material by means of which the prior transport stacks were held together could not be directly re-used as such.

If it is ensured, according to the invention, that the blanks are fed to the individual winding cores with basically the same orientation, for example with their upper edge in front, it is furthermore ensured that the blanks stored on the winding cores are also conveyed, correctly oriented, to a further-processing unit since the blanks can be unwound in only one direction, for which reason the orientation of the blanks conveyed away from the winding cores is clearly determined by the orientation of said blanks during winding up.

By virtue of storing blanks on winding cores, it is, in addition, possible to produce a continuous blank stream leading to a further-processing unit, since the further-processing unit can be coupled to an unwinding apparatus, which exhibits, for example, two roll mounts which can optionally be used for charging the further-processing unit. It is thus possible always for one roll to ensure the feed of blanks to the further-processing unit, while the other, already previously emptied roll is exchanged for a new, full roll. By means of a corresponding switch designed, for example, in accordance with U.S. Pat. No. 5,158,278, it can, in this arrangement, be ensured that the beginning of the blank stream of one roll adjoins the end of the blank stream of the other roll without interruption.

An apparatus for unwinding the blanks stored on the winding cores may be designed, for example, in accordance with U.S. Pat. Nos. 5,158,242 and 4,898,336.

According to the invention, the blanks, occurring individually one after the other, are fed, before being wound up onto the winding core, to an intermediate store designed, in particular, as a blank stack.

The provision of the intermediate store permits separation of the blank stream leading, for example, from a cutting device to the intermediate store and the blank stream leading from the intermediate store to the winding core. This separation results in the situation where the blank stream leading to the intermediate store and the blank stream running away from the blank store can run at different speeds, in particular even a brief interruption in the blank stream delivering the blanks to the intermediate store not being detrimental.

There is consequently no need for high-outlay synchronization of the winding apparatus with the unit providing the blank stream, for example a cutting device. By virtue of the intermediate store, designed as a blank stack, a uniform and continuous blank stream leading to the winding core can thus be produced, irrespective of speed fluctuations or interruptions in the blank stream leading to the intermediate store.

Furthermore, the inclusion of the intermediate store, designed as a blank stack, can effect correct alignment of the intermediately stored blanks since the blanks, delivered, for example, in a non-precisely aligned manner from a cutting device, can be guided into a defined position by corresponding guide elements provided at the blank stack, as a result of which a precisely aligned blank stream running away from the intermediate store can be produced.

In addition, the blank stack, serving as intermediate store, also makes it possible for the blanks, initially occurring individually one after the other, to be made into an imbricated stream, in the case of which the successive blanks overlap in certain areas. The mode of functioning of such a stacking device is explained in more detail hereinbelow with reference to the figures.

By virtue of an imbricated stream fed to the winding core, it is possible to drive the winding core at low speeds since, with the provision of an imbricated formation, more blanks can be fed to the winding core per unit of time than with the provision of a blank stream with blanks arranged individually one after the other. In this arrangement, the closer the selected imbrication spacing, the lower the speeds of rotation of the winding core can be. In this arrangement, the winding-band length may also be shorter.

During winding up of the blanks onto a winding core, it is advantageous to have the narrower side of the blanks run in a circumferential direction of the winding core since only slight bending of the individual blanks takes place during winding up. This can be achieved, for example, in that the conveying belts running away from the intermediate store are arranged perpendicularly to the conveying belts leading to the intermediate store.

BRIEF DESCRIPTION OF THE DRAWINGS

Some of the objects and advantages of the present invention having been stated, others will appear as the description proceeds, when taken in conjunction with the accompanying somewhat schematic drawings, in which.

DETAILED DESCRIPTION OF THE PREFERRED EMBODIMENTS

Figure 1:
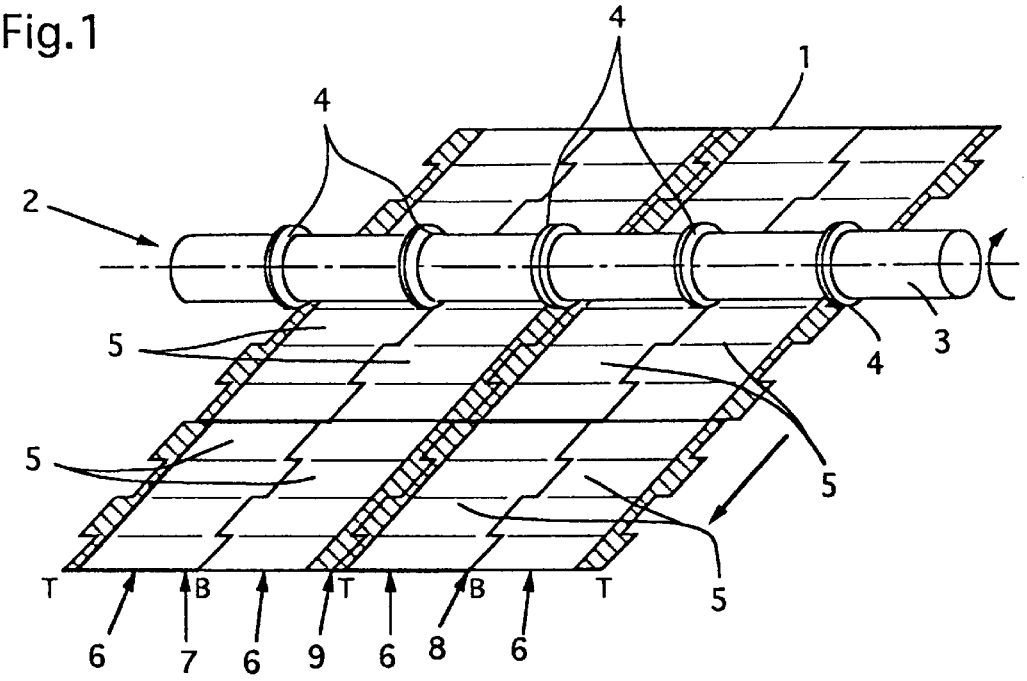
FIG. 1 shows a schematic representation of a cutting device for producing blanks.

FIG. 1 shows a cutting device for producing blanks to be stored according to the invention, in the case of which a material web 1 is guided, in the direction of the arrow, beneath a rotating cutter arrangement 2. In this arrangement, the material web 1 consists, for example, of packaging material, in particular of cardboard on which printing has already been carried out and which, if appropriate, has been coated in accordance with the propose for which it is subsequently intended.

The cutter arrangement 2 comprises a shaft 3 which extends perpendicularly to the conveying direction of the material web 1 and on which there are arranged cutters 4, which are represented merely schematically in FIG. 1 and extend in the circumferential direction of the shaft 3. In this arrangement, the cutters 4—as cannot be seen in FIG. 1—are designed such that they can provide the material web 1 with cuts running in different directions, this resulting, for example, in a periodically recurring cut contour in pulse form according to FIG. 1.

By virtue of having a total of five cutters 4 provided on the shaft 3, the material web 1 is subdivided into four webs 6, which are located one beside the other and exhibit blanks 5 following one after the other in the conveying direction in each case.

Since the blanks 5 to be produced according to FIG. 1 are of a form, on their upper edge T (top), which is inverted with respect to their lower edge B (bottom), the webs 6 are oriented with respect to one another, for the purposes of saving material and reducing waste, such that either, as represented at 7 and 8, the lower edges or, as represented at 9, the upper edges of the respectively bordering webs 6 touch.

This results in the upper edges T, which are represented in FIG. 1 by hatching, of the blanks 5 being directed inwards in the case of the two inner webs and outwards in the case of the two outer webs. Blanks bordering one another transversely to the conveying direction are thus rotated through 180° in a horizontal plane with respect to one another.

Figure 2:
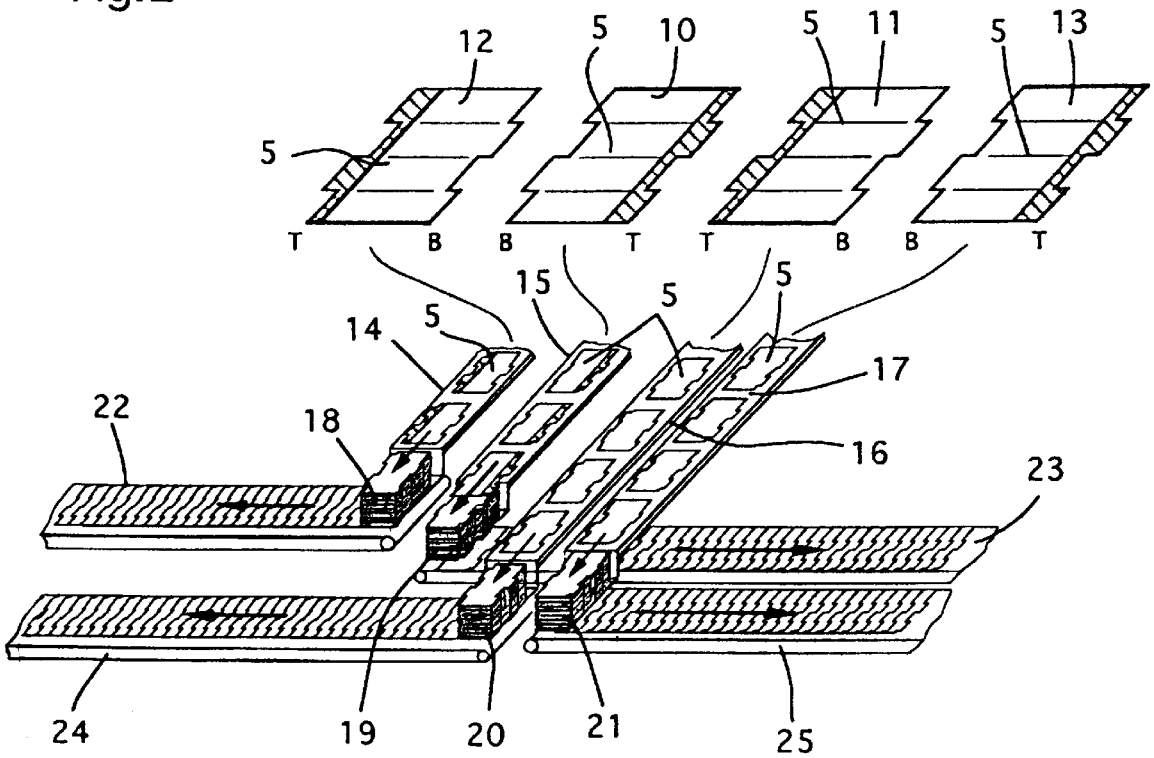
FIG. 2 shows four blank stacks which are each coupled to a feeding means and removal means.

FIG. 2 shows the blanks 5 coming from a device according to FIG. 1, arranged one beside the other and oriented in the abovementioned manner, i.e. the upper edges T of the two central blanks 10, 11 are directed inwards and the upper edges T of the two outer blanks 12, 13 are directed outwards.

The blanks 5, which still touch one another in this device according to FIG. 1, are, according to FIG. 2, moved onto conveying belts 14, 15, 16, 17 arranged in parallel one beside the other, with the result that, ultimately, a separate conveying belt is assigned, according to FIG. 1, to each web 6 or to each series of blanks 5.

Each of the conveying belts 14, 15, 16, 17 conveys the respective blanks 12, 10, 11, 13 to a separate blank stack 18, 19, 20, 21 in each case. In this arrangement, the blanks 12, 10, 11, 13 are fed to the blank stacks 18, 19, 20, 21 from the top, said blanks each being horizontally pushed over the respectively uppermost blank of a stack, in accordance with the arrows shown in FIG. 2.

The blanks stored one on top of the other in the blank stacks 18, 19, 20, 21 are guided away from the underside of said stacks via conveying belts 22, 23, 24, 25 each assigned to a blank stack 18, 19, 20, 21. The blanks 12, 10, 11, 13 are positioned on said conveying belts 22, 23, 24, 25 in an imbricated formation, this positioning operation being described in more detail with reference to FIGS. 5 and 6.

The conveying belts 22, 23, 24, 25 run perpendicularly to the conveying belts 14, 15, 16, 17, the conveying belts 22, 24 conveying in the opposite direction from the conveying belts 23, 25.

The blank stacks 20, 21 corresponding with the conveying belts 16, 17 are offset, in the conveying direction of the conveying belts 14, 15, 16, 17, with respect to the blank stacks 18, 19 corresponding with the conveying belts 14, 15. In order, despite this offset, to link up the conveying belts 16, 17 with the blank stacks 20, 21, said belts extend in their conveying direction to beyond the conveying belt 23 running away from the blank stack 19.

FIG. 2 thus results in an arrangement in which, from the blank stacks 18, 19, 20, 21, those blanks 11, 12 whose upper edges T are directed towards the left are conveyed away to the left by the conveying belts 24 and 22, and those blanks 10, 13 whose upper edges T are directed towards the right are conveyed away to the right by the conveying belts 23 and 25, in each case to a winding apparatus (not shown in FIG. 2).

With this principle, it is thus ensured that, on all the conveying belts 22, 23, 24, 25 running away from the blank stacks 18, 19, 20, 21, the blanks are oriented in such a manner that their upper edge T is in front. Rolls in which the wound-up blanks are oriented in the same direction can thus be produced by each winding apparatus adjoining the conveying belts 22, 23, 24, 25 running away from the blank stacks 18, 19, 20, 21. During further processing of the rolls, this identical orientation means that care no longer has to be taken as to which of the four winding apparatuses adjoining the conveying belts 22, 23, 24, 25 the respective roll comes from.

Figure 3:
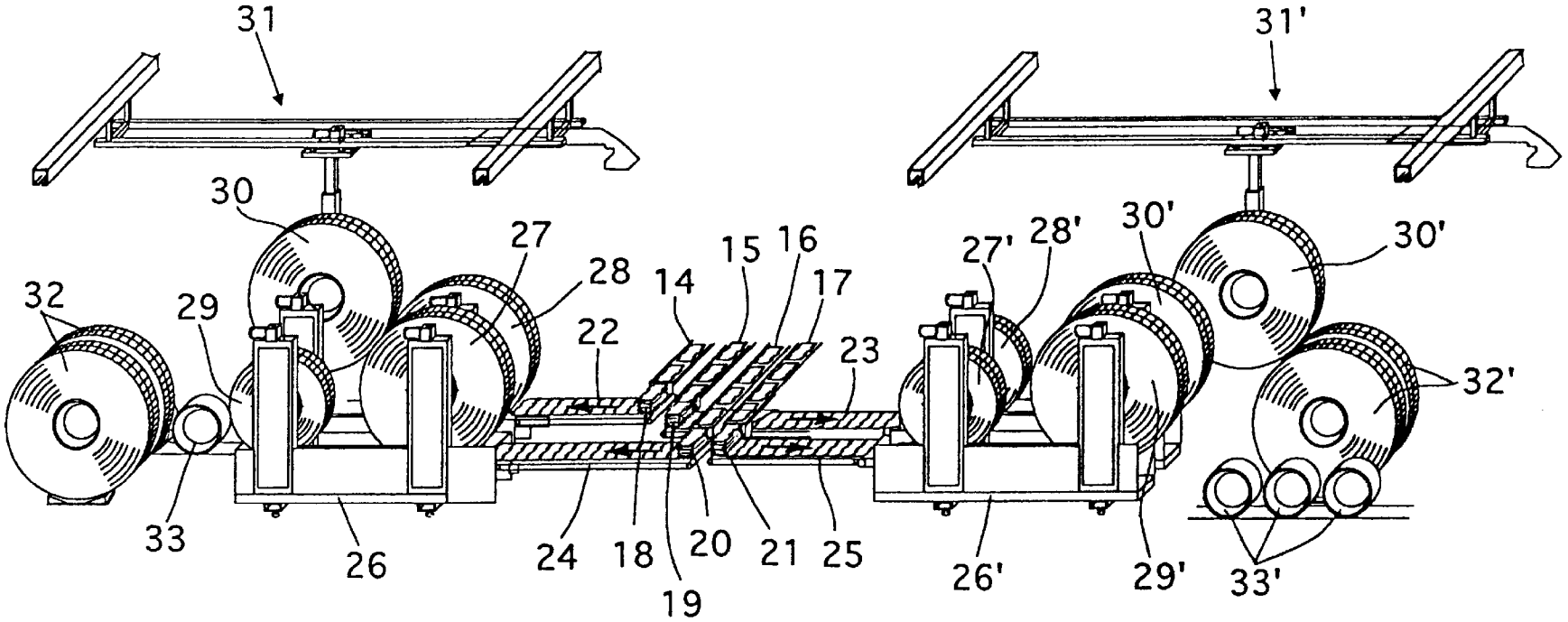
FIG. 3 shows an embodiment of an apparatus, according to the invention, with four blank stacks.

FIG. 3 shows an apparatus 14-25 according to FIG. 2, which adjoins corresponding winding apparatuses.

In this arrangement, the two conveying belts 22, 24 extending to the left according to FIG. 2 are coupled to a framework 26 which is suitable for receiving four winding cores.

In this arrangement, two rolls 27, 29 arranged one behind the other can be charged via the conveying belt 24, said conveying belt 24 being coupled to a switch (not shown in FIG. 3), which is designed, for example, in accordance with U.S. Pat. No. 5,158,278 and via which optionally the roll 27 or the roll 29 can be charged with blanks.

The same goes for the conveying belt 22 and the rolls 28, 30.

Arranged above the framework 26 is a roll-transporting apparatus 31, by means of which the filled roll 30 can be removed from the framework 26 and transported to a storage area 32. The roll-transporting apparatus 31 may likewise be used for introducing empty winding cores 33 into the framework 26 for subsequent winding.

The winding apparatus arranged at the end of the two conveying belts 23, 25 running away to the right from the blank stacks 18, 19, 20, 21 is provided with the reference numerals 26' to 33' and is designed in a manner corresponding to the winding apparatus described above.

The apparatus represented in FIG. 3 functions as follows:

The individual blanks are fed in four parallel webs, via the conveying belts 14, 15, 16, 17, to the blank stacks 18, 19, 20, 21 and are guided away from said blank stacks, from the underside thereof, via the conveying belts 22, 23, 24, 25. It has already been explained with reference to FIG. 2 that the blanks, in this arrangement, are each oriented on the conveying belts 22, 24 and 23, 25, which convey in opposite directions, in such a manner that their upper edge is in front.

The imbricated blank streams, formed by the interaction of the blank stacks 18, 19, 20, 21 with the conveying belts 22, 23, 24, 25, pass, via the conveying belts 22, 23, 24, 25, to in each case one roll 27, 27', 28, 28', 29, 29', 30, 30', which is retained in the framework 26, 26' and is driven in rotation there.

Since each conveying belt 22, 23, 24, 25 is assigned in each case one switch and in each case one front roll and one rear roll, each of said conveying belts may optionally charge the front roll or the rear roll. It is thus possible, in an advantageous manner, to process and/or to store a continuous imbricated stream, leading to the respective winding apparatus, without the imbricated stream having to be interrupted during the exchange of a full roll for an empty roll since, for example, a fully wound front roll can be exchanged for an empty winding core whenever the rear roll is being wound, and vice versa.

In an advantageous manner, the rolls, mounted rotatably in a framework 26, 26' in each case, are wound in such a time sequence that the situation where two rolls are fully wound, and have to be exchanged for empty winding cores, at the same point in time, is prevented since, otherwise, two rolls would have to be exchanged simultaneously by the roll-transporting apparatus 31, 31'. Such staggered interaction of the roll-transporting apparatus 31, 31' with the individual rolls means that all the transporting operations can be carried out, for example, by a single transporting arm. With corresponding time control of the overall apparatus, it is even possible to combine the roll-transporting apparatuses 31, 31' to give a single roll-transporting apparatus, which then serves all the rolls retained in the frameworks 26, 26' by means of a single transporting arm.

Figure 4:
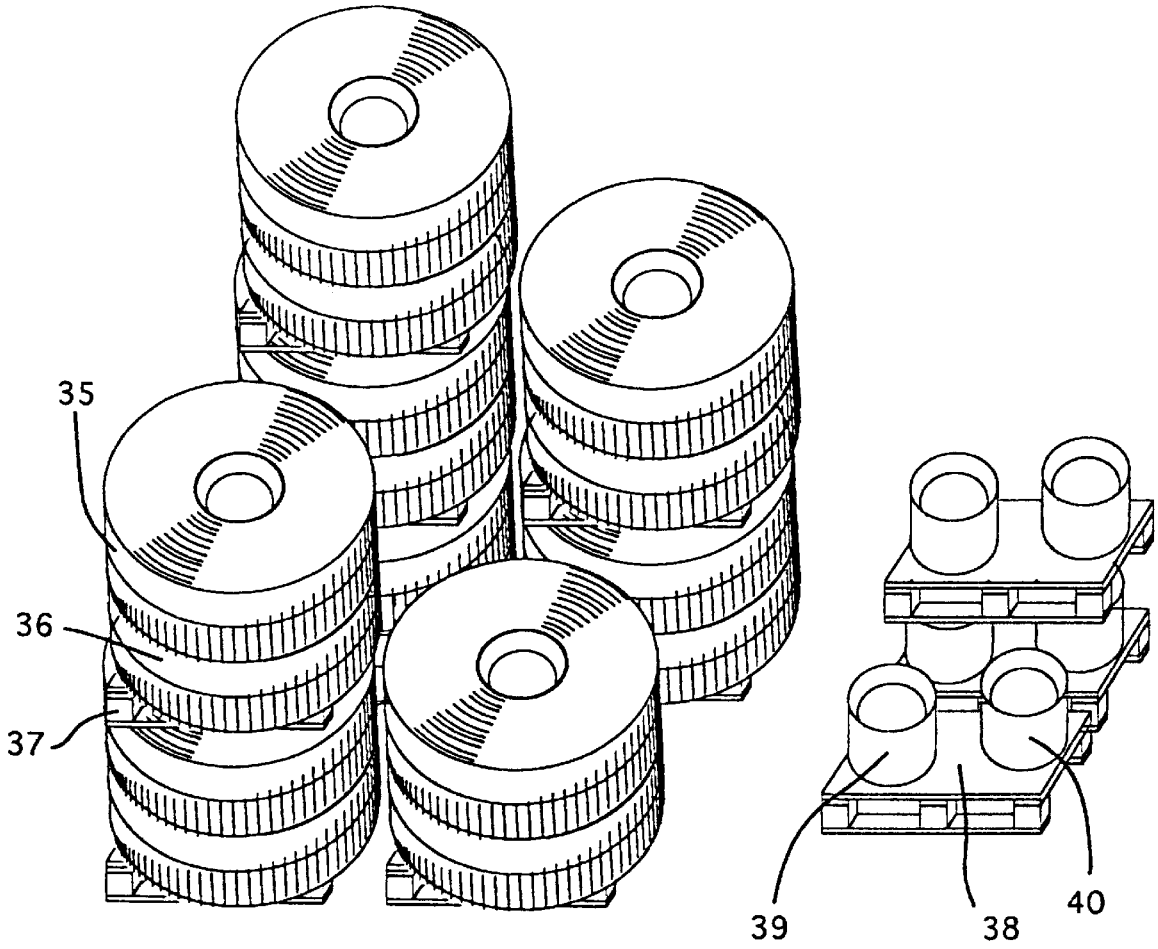
FIG. 4 shows rolls and winding cores stacked on pallets.

FIG. 4 shows wound rolls and empty winding cores stacked on pallets.

Rolls 35, 36 produced according to the invention may preferably be stacked in pairs on in each case one pallet 37. The rolls 35, 36 are arranged on a pallet 37 with vertically extending axes of rotation and such that they touch one another with their end sides.

As represented in FIG. 4, a plurality of pallets 37 loaded in this manner can be stacked one on top of the other, this resulting in optimum utilization of the storage space.

Empty winding cores 39, 40 can likewise be deposited on pallets 38, which are designed identically to the pallets 37. In this arrangement, however, the empty winding cores 39, 40 are not located one on top of the other, but one beside the other, with vertically extending axes of rotation.

When storing fully wound rolls 35, 36 and empty winding cores 39, 40 on pallets 37, 38, respectively, it is advantageous that the pallets 37, 38, preferably exhibiting standard dimensions, can be transported without any difficulty by a commercially available fork lift truck.

Furthermore, the transporting operation between the blank-storage apparatus and an apparatus for the further process of the blanks can be carried out particularly effectively since the same pallets 37, 38 can be used, on the one hand, in order to transport the fully wound rolls 35, 36 to the further-processing apparatus and, on the other hand, also to transport the empty winding cores 39, 40 from the further-processing apparatus to the blank-storage apparatus.

Figure 5:
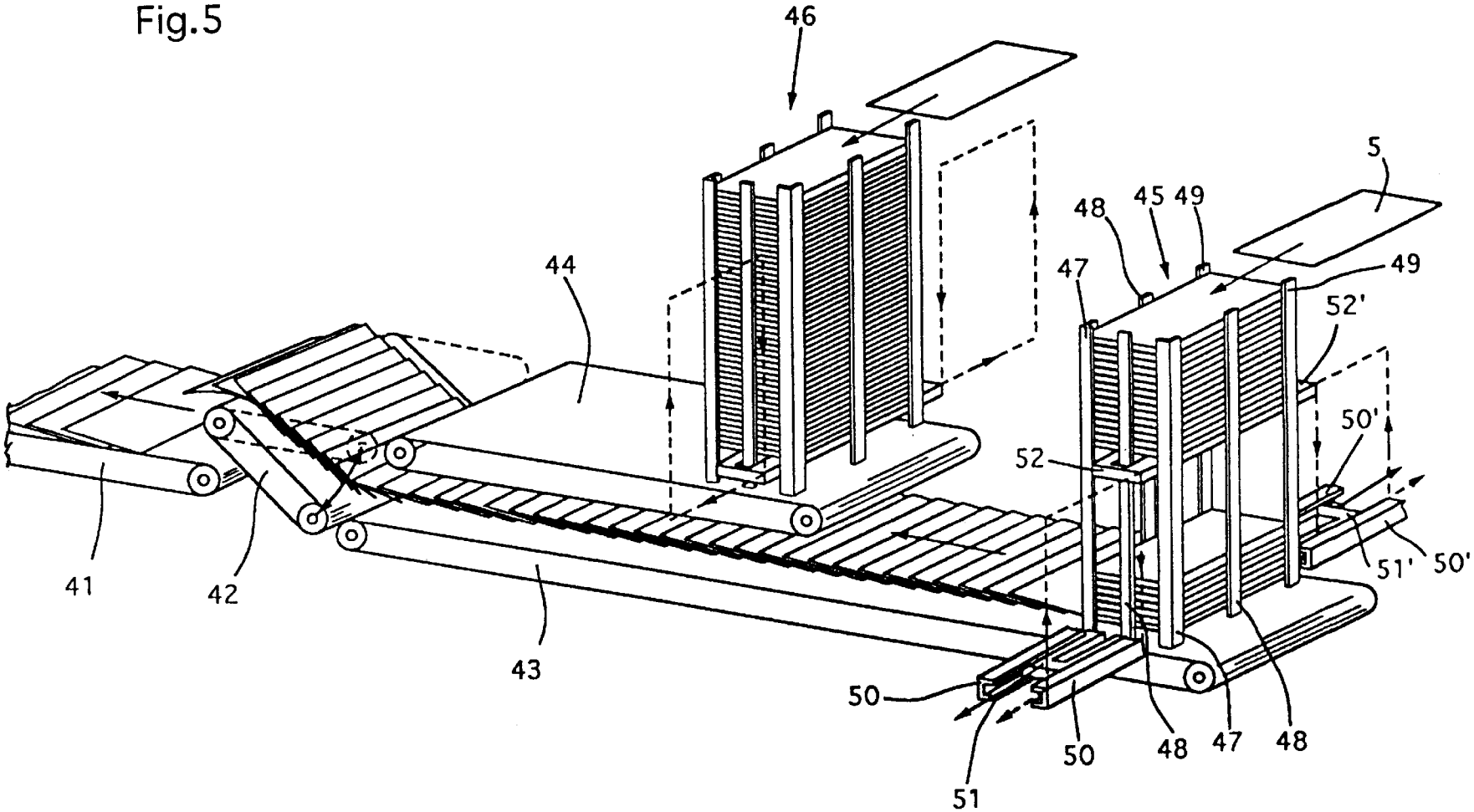
FIG. 5 shows two blank stacks assigned to a common conveying device.

FIG. 5 shows a stacking device for forming the blank stacks, serving, according to the invention, as intermediate stores.

A conveying belt 41, leading to a winding apparatus (not shown) is coupled to a belt rocker 42, which is designed, for example, in accordance with U.S. Pat. No. 5,158,278 and via which the conveying belt 41 can be optionally coupled to a conveying belt 43 or to a conveying belt 44. In this arrangement, the conveying belts 43, 44 are located vertically one above the other and parallel to one another.

At that end of the conveying belt 43 which is remote from the belt rocker 42 there is arranged, on the upper side of said belt, a stacking device 45 which exhibits vertically extending guide elements 47, 48, 49 which are spaced apart from one another in such a manner that, on the one hand, they prevent horizontal movement of blanks received between them, but, on the other hand, they permit vertical movement of said blanks.

The stacking device 45 is charged with blanks 5, in the direction of the arrow, which are horizontally pushed over the uppermost stacked blank from the top. In this arrangement, the guide elements 49 located in the charging direction are designed such that they form between them a horizontally extending interspace into which blanks 5 can be pushed laterally.

In contrast to the guide elements 49, the guide elements 47, which are of angular design and are provided at that end of the stacking device 45 which is remote from the guide elements 49, are configured such that they form a stop surface for pushed-in blanks 5, as a result of which the horizontal movement of the blanks 5 is stopped after said blanks have been positioned on the stack.

The guide elements 48, provided between the guide elements 47 an 49, serve for improved alignment of the stacked blanks 5.

The stacking device 45 is, furthermore, provided with pushers 51, 51' which can move, in U-shaped profile rails 50, 50', in the horizontal direction between the stacked blanks 5, in each case one pusher pair 51, 51', arranged at the same vertical height, being actuated together and interacting in this manner.

By means of said pushers 51, 51', which can be moved into the blank stack, the very situation where stacked blanks on the underside of the stacking device pass onto the conveying belt 43 can be prevented. This is important if, as in the case shown in FIG. 5, a conveying belt 41 is to be capable of being charged via two different stacking devices 45, 46, since, in this case, only one stacking device can be operative at any one time, while, in the case of the other stacking device, the abovementioned pushers 51, 51' prevent the situation where blanks pass onto the conveying belt 41 via the corresponding conveying belt and the downstream belt rocker 42.

Preferably, each stacking device 45, 46 is provided with in each case two pusher pairs 51, 51' and 52, 52', the two pusher pairs 51, 51', 52, 52', both of which can move vertically along the blank stack, being suitable for receiving a specific number of blanks between them. In this manner, it is ensured that a predetermined number of blanks is always delivered from each stacking device 45, 46 before changeover to the respectively other stacking device 46, 45.

The stacking device 46 coupled to the conveying belt 44 is of precisely the same construction as the stacking device 45 coupled to the conveying belt 43.

Upon operation of the apparatus according to FIG. 5, the two stacking devices 45, 46 are, at the same time, continuously charged with blanks 5 from the top, but it is only from one of the two stacking devices 45, 46 in each case that stacked blanks are fed, from the underside of said stacking devices, as an imbricated stream to the conveying belt 41 via the belt rocker 42, while the respectively other stacking device 46, 45 is separated from the respective conveying belt 43, 44 by a pusher pair moved in each case beneath the intermediately stored stack.

As soon as a stack which is intermediately stored between two pusher pairs of the first stacking device has been fully conveyed away from said first stacking device, said stacking device is separated, by means of a pusher pair, from the conveying belt assigned to it, simultaneously the lowermost pusher pair of the second stacking device being drawn out of the second stacking device with simultaneous changeover of the belt rocker 42, as a result of which blanks are then conveyed away from the second stacking device. After the stack of blanks stored between two pusher pairs in the second stacking device has been fully conveyed away, corresponding changeover to the first stacking device then takes place.

With the corresponding design of the belt rocker 42, a single conveying belt 41 can, accordingly, be charged continuously, from two blanks stacks 45, 46, with a blank stream occurring in imbricated formation, while the two stacking devices 45, 46 are likewise continuously filled from the top with blanks occurring individually one after the other. All that needs to be taken into account, in this arrangement, is that the conveying belt running away from the stacks has to convey double the amount of blanks per unit of time as a conveying belt which charges a stack.

Figure 6:
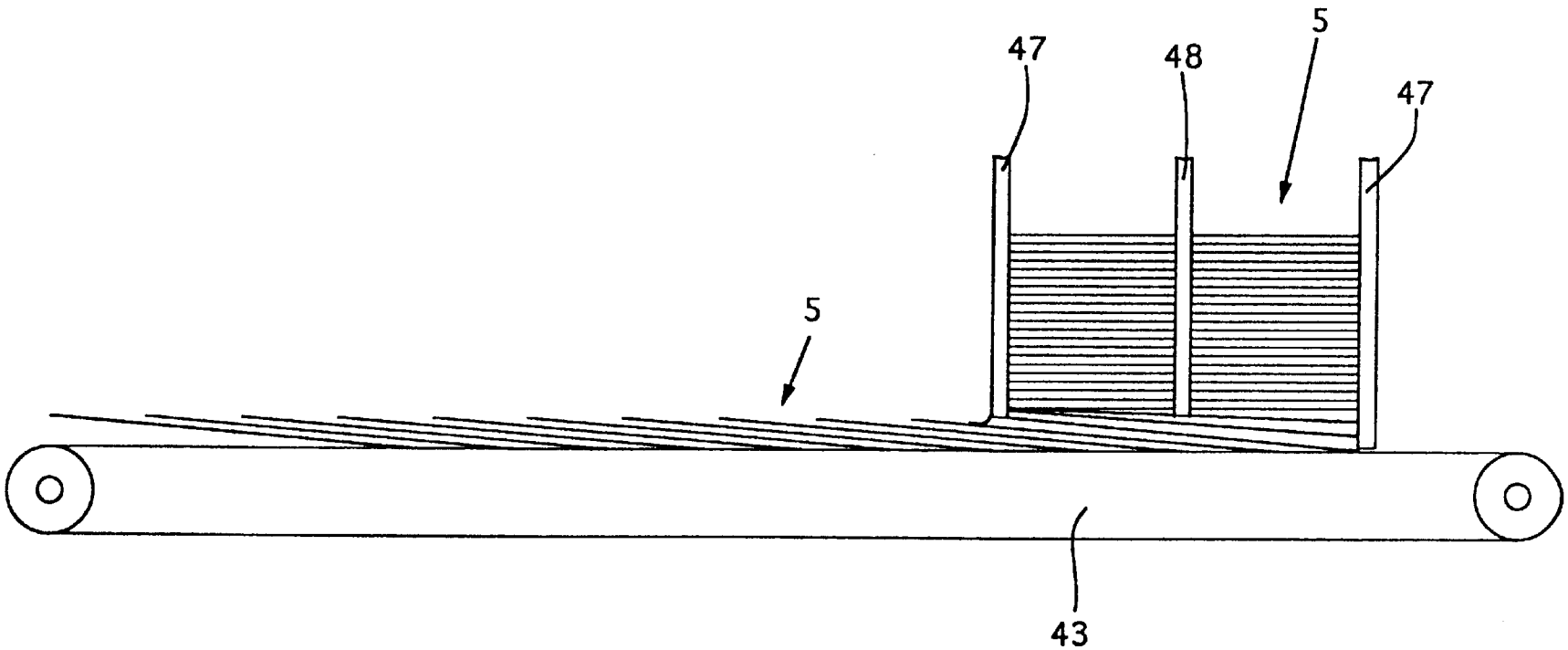
FIG. 6 shows a device for producing an imbricated stream.

FIG. 6 illustrates the functioning principle of a stacking devices according to FIGS. 2, 3 and 5.

Three guide elements 47, 48 extending vertically in accordance with FIG. 5 are shown, horizontal blanks 5 being received between said guide elements. In this arrangement, the blanks 5 are fixed in their horizontal position by the guide elements 47, 48, vertical movement of the blanks 5 within the guide elements 47, 48, however, being possible.

Arranged beneath the guide elements 47, 48 is a conveying belt 43 which extends perpendicularly to the guide elements 47, 48. In this arrangement, the conveying belt 43 forms, as it were, the base of the stacking device formed by the guide elements 47, 48, the stacked blanks 5 bearing on said base.

The guide element 47 which is at the front in the conveying direction is at a greater vertical distance from the conveying belt 43 than the guide element 47 which is at the rear in the conveying direction.

During operation of the conveying belt 43, that blank 5 which bears on the conveying belt 43 is moved out from beneath the blank stack in the conveying direction by virtue of the friction existing between blank 5 and conveying belt 43. Before, however, said blank 5 has fully left the region located beneath the stacking device, the rear region of the blank stacked above said first blank has, due to the action of gravity, already passed onto the conveying belt 43, whereupon said second blank too, as a result of the frictional forces existing between it and the conveying belt 43, is moved out in the conveying direction from the region located beneath the blank stack.

The same occurs with all the subsequent blanks stacked in the stacking device.

In this manner, the imbricated stream represented in FIG. 6 is obtained, in the case of which stream the individual blanks 5 transported by means of the conveying belt 43 overlap in certain areas. In this arrangement, the leading edge of the individual blanks lies on the preceding blank in each case.

By adjusting the vertical distance between the conveying belt 43 and the guide element 47 which is at the front in the conveying direction, the overlapping region of the successive blanks can be changed. A relatively large distance between guide element 47 and conveying belt 43 results, in this arrangement, in a large degree of overlapping or a close-together imbricated stream.

FIG. 7 illustrates once again the conveying principle in accordance with FIGS. 2 and 3, in the case of which four different blank stacks 18, 19, 20, 21 are charged with blanks 12, 10, 11, 13 from the top, whereupon the blanks are conveyed away to the left and right from the underside of the blank stacks 18, 19, 20, 21.

Figure 7:
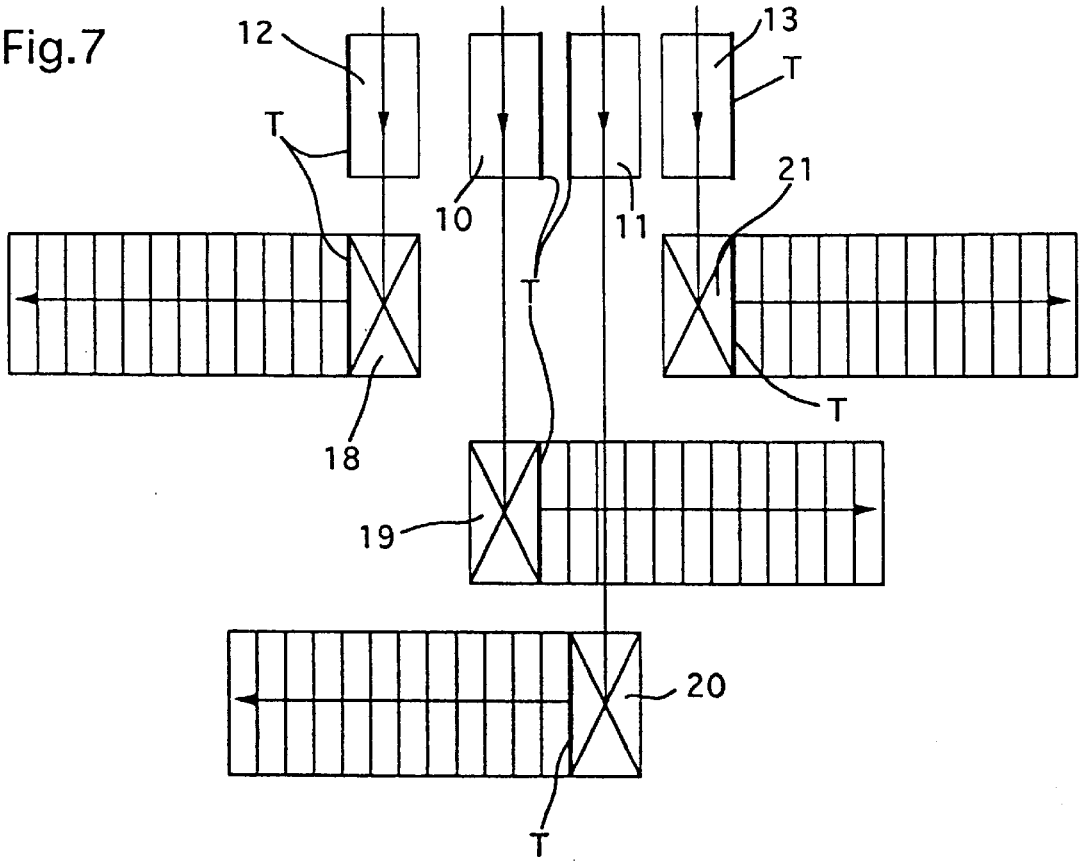
FIG. 7 shows a diagram illustrating the path over which blanks are conveyed in the case of a process according to the invention, each blank stack being assigned a separate removal means.

The upper edge T of the individual blanks is identified by a bold line in FIG. 7.

As has already been explained with reference to FIG. 2, the conveying means leading to the blank stacks 18, 19, 20, 21 and the conveying means running away from said blank stacks are arranged such that the individual blanks are conveyed away from the blank stacks 18, 19, 20, 21, in the direction of the winding apparatuses (not shown in FIG. 7), each with their upper edge in front.

Figure 8:
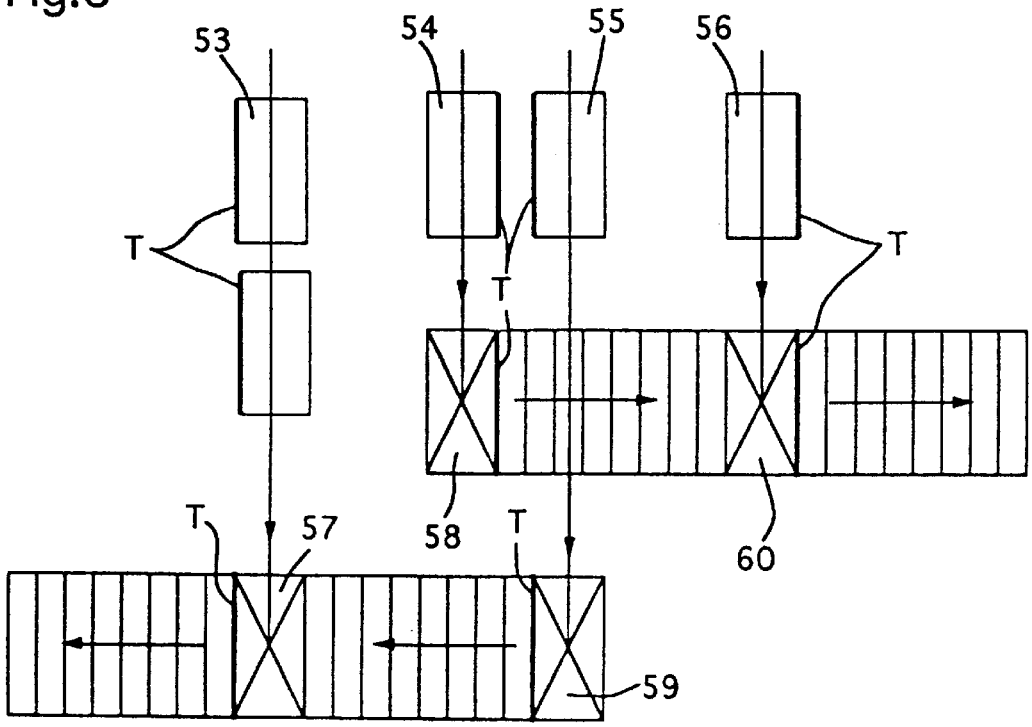
FIG. 8 shows a further diagram illustrating the path over which blanks are conveyed in the case of a process according to the invention, in each case two blank stacks being assigned, as in FIG. 5, to a common removal means.

FIG. 8 shows a conveying principle, in the case of which use is made of two conveying apparatuses according to FIG. 5.

The blanks 53, 54, 55, 56, fed to the blank stacks 57, 58, 59, 60 from the top, are oriented in precisely the same manner as in FIGS. 2, 3 and 7, that is to say the upper edges T of the two central blank webs are directed inwards, and the upper edges T of the two outer blank webs are directed outwards.

In the principle represented in FIG. 8, in each case one apparatus according to FIG. 5 is charged with two blank streams, in the case of which the upper edges of the blanks 53, 55 and 54, 56, respectively, are oriented in the same direction.

That apparatus which is charged with the blanks 54, 56, of which the upper edges are directed to the right, conveys away the blanks intermediately stored in the blank stacks 58, 60 to the right.

That apparatus which is charged with the blanks 53, 55, of which the upper edges are directed to the left, conveys away the blanks intermediately stored in the blank stacks 57, 59 to the left.

This results in an imbricated stream running to the right and an imbricated stream running to the left, of which each is oriented such that in each case the upper edge of the conveyed blanks is at the front in the conveying direction.

Of course, the material web 1 can, depending on its width, be divided up into different numbers of webs 6 and a corresponding number of blank stacks may be present, or identically oriented blanks may be collected together and moved into the same stack shaft.

In the drawings and specification, there has been set forth a preferred embodiment of the invention, and although specific terms are employed, they are used in a generic and descriptive sense only and not for purposes of limitation.

That which is claimed:

1. A process for storing stackable, sheet-like blanks comprising the steps of feeding the blanks individually one after the other to an intermediate store which comprises a stack of the blanks, withdrawing the blanks from the intermediate store and feeding the withdrawn blanks in an essentially continuous stream to a winding station, and winding the stream of blanks into a roll at the winding station.

2. The process as defined in claim 1 wherein the withdrawing step includes withdrawing the blanks in an imbricated stream by means of a conveying belt.

3. The process as defined in claim 1 wherein the feeding step includes feeding the blanks by means of a conveying belt.

4. The process as defined in claim 1 wherein the feeding step includes feeding the blanks onto the top of the intermediate store, and wherein the withdrawing step includes withdrawing the blanks essentially horizontally from the bottom of the intermediate store.

5. The process as defined in claim 1 wherein the winding station includes front and rear roll supporting cores, and wherein the winding step includes alternately winding the blanks onto one of said cores and then onto the other of said cores.

6. The process as defined in claim 5 wherein the winding step further includes exchanging an empty core for a full one of said cores during the winding of the other of said cores.

7. The process as defined in claim 1 wherein the blanks being fed during the feeding step are conveyed in a conveying direction and define opposite edges which extend generally parallel to the conveying direction, and wherein during the withdrawing step the blanks are conveyed in a withdrawing direction and the opposite edges of the blanks are disposed generally perpendicular to the withdrawing direction.

8. A process for storing stackable, sheet-like blanks comprising the steps of feeding the blanks individually one after the other in each of a plurality of parallel blank streams and to respective intermediate stores, with each of said intermediate stores comprising a stack of the blanks, withdrawing the blanks from each of the intermediate stores and feeding the withdrawn blanks in respective essentially continuous streams to respective winding stations, and winding each of the streams of blanks into respective rolls at each of the winding stations.

9. The process as defined in claim 8 wherein the feeding step includes feeding the blanks in a conveying direction and severing an advancing unitary sheet along lines which are generally parallel to the conveying direction and along other lines which are transverse to the conveying direction so as to form the parallel blank streams.

10. The process as defined in claim 8 wherein the withdrawing step includes conveying the withdrawn blanks from each intermediate store to a respective winding station.

11. The process as defined in claim 8 wherein the withdrawing step includes conveying the blanks from at least two intermediate stores to a single winding station.

* * * * *